US011139615B2

(12) United States Patent
Ohfuku et al.

(10) Patent No.: US 11,139,615 B2
(45) Date of Patent: Oct. 5, 2021

(54) CONNECTOR

(71) Applicants: YAZAKI CORPORATION, Tokyo (JP); HONDA MOTOR CO., LTD., Tokyo (JP)

(72) Inventors: Ryosuke Ohfuku, Makinohara (JP); Tomoyuki Miyakawa, Utsunomiya (JP); Kazuyuki Iwashita, Wako (JP); Taro Shimizu, Wako (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/893,285

(22) Filed: Jun. 4, 2020

(65) Prior Publication Data

US 2020/0388964 A1 Dec. 10, 2020

(30) Foreign Application Priority Data

Jun. 4, 2019 (JP) ..... JP2019-104558

(51) Int. Cl.
*H01R 13/627* (2006.01)
*H01R 13/639* (2006.01)
*H01R 24/20* (2011.01)

(52) U.S. Cl.
CPC ..... *H01R 13/639* (2013.01); *H01R 13/6272* (2013.01); *H01R 24/20* (2013.01)

(58) Field of Classification Search
CPC ..... H01R 13/639; H01R 13/6273
USPC ..... 439/352
See application file for complete search history.

(56) References Cited

U.S. PATENT DOCUMENTS 5,993,238 A 11/1999 Kudo et al.
6,059,597 A 5/2000 Endo et al.
6,126,480 A * 10/2000 Kawase ..... H01R 13/6272 439/352
6,533,600 B1 * 3/2003 Kashiyama ..... H01R 13/641 439/352
6,811,424 B2 * 11/2004 Seminara ..... H01R 13/639 439/188

(Continued)

FOREIGN PATENT DOCUMENTS

JP H9-237653 A 9/1997
JP 2002-280118 A 9/2002

(Continued)

*Primary Examiner* — Neil Abrams
(74) *Attorney, Agent, or Firm* — Kenealy Vaidya LLP

(57) ABSTRACT

A connector includes: a housing which is connected to a counterpart connector; and a slider held in the housing to be movable in a fitting direction. The housing and the slider include: a guide mechanism configured to guide a movement of the slider to the housing in the fitting direction; and a stopper mechanism configured to prevent the slider from being detached from the housing to the front side of the connector in the fitting direction. The guide mechanism has: a pair of ribs provided in one of the housing and the slider, the ribs extending in the fitting direction; and a pair of grooves provided in the other of the housing and the slider, the grooves extending in the fitting direction. The stopper mechanism is provided at a location adjacent to an end part of the guide mechanism at the front side of the connector in the fitting direction.

6 Claims, 18 Drawing Sheets

(56) References Cited

U.S. PATENT DOCUMENTS

| | | | | |
|---|---|---|---|---|
| 6,945,801 | B2 * | 9/2005 | Brown | H01R 13/641 439/188 |
| 7,806,715 | B2 * | 10/2010 | Zheng | H01R 13/641 439/352 |
| 8,016,606 | B1 * | 9/2011 | Kwan | H01R 13/641 439/352 |
| 8,137,142 | B1 * | 3/2012 | Dawson | H01R 13/639 439/676 |
| 8,678,846 | B2 * | 3/2014 | Hitchcock | H01R 13/641 439/352 |
| 8,926,355 | B2 * | 1/2015 | Heil | H01R 13/641 439/352 |
| 9,142,919 | B2 * | 9/2015 | Osada | H01R 13/642 |
| 9,543,697 | B2 * | 1/2017 | Nakashima | H01R 13/6272 |
| 10,305,221 | B2 * | 5/2019 | Ohfuku | H01R 13/641 |
| 10,637,194 | B1 * | 4/2020 | Kim | H01R 13/639 |
| 10,714,869 | B2 * | 7/2020 | Endo | H01R 13/6273 |
| 10,756,485 | B2 * | 8/2020 | Ohfuku | H01R 13/6272 |
| 10,784,625 | B2 * | 9/2020 | Narama | H01R 13/641 |
| 11,005,216 | B2 * | 5/2021 | Hayasaka | H01R 13/641 |
| 2002/0132516 | A1 | 9/2002 | Kashiyama et al. | |
| 2004/0102075 | A1 | 5/2004 | Nakamura | |
| 2020/0203890 | A1 * | 6/2020 | Ohfuku | H01R 13/6275 |
| 2020/0388963 | A1 * | 12/2020 | Ohfuku | H01R 13/6271 |
| 2020/0388964 | A1 * | 12/2020 | Ohfuku | H01R 13/6272 |

FOREIGN PATENT DOCUMENTS

| | | | |
|---|---|---|---|
| JP | 2004-134258 | A | 4/2004 |
| JP | 6023580 | B2 | 11/2016 |

* cited by examiner

CONNECTOR

CROSS-REFERENCE TO RELATED APPLICATIONS

This application is based on and claims priority under 35 USC 119 from Japanese Patent Application No. 2019-104558 filed on Jun. 4, 2019, the contents of which are incorporated herein by reference.

TECHNICAL FIELD

The present disclosure relates to a connector.

BACKGROUND ART

In a related art, disclosed is a connector connection structure in which a connector on the side of an inflator provided in the inflator of an in-vehicle airbag system and a connector on the side of a wire harness that supplies a control signal to the inflator are fitted to each other (for, example, refer to Japanese Patent No. 6023580).

For example, a housing of the connector on the side of the wire harness described in Japanese Patent No. 6023580 includes: a slider held in the housing to be movable in a fitting direction and energized to the front side in the fitting direction by an energizing member; and a stopper mechanism for preventing the slider from being detached from the housing to the front side in the fitting direction.

During a fitting operation of the connectors thereof, the slider abuts on the connector on the side of the inflator, whereby the slider acts to apply a force to the front side in the fitting direction caused by an energizing force of the energizing member to the connector on the side of the inflator. Accordingly, in an incompletely fitted state of the connectors, since the slider acts to keep the front sides of the two connectors in the fitting direction away from each other, an abnormality in the incompletely fitted state is easily detected.

SUMMARY OF INVENTION

Meanwhile, in the above-described connector on the side of the wire harness, it is important to stably move the slider in the fitting direction with respect to the housing. Even when moment rotating in a width direction as an axis acts on the slider due to an unintended external force, it is important to prevent a state, as much as possible, in which the slider is detached from the housing by breaking through the stopper mechanism. In the connector on the side of the wire harness described in Japanese Patent No. 6023580, it is required to further improve the above-described drawbacks.

The present disclosure provides a connector not only capable of stably moving a slider in a fitting direction with respect to a housing, but also capable of preventing a state, as much as possible, in which the slider is detached from the housing by breaking through a stopper mechanism.

According to a first illustrative aspect of the present disclosure, a connector is configured to be fitted to a counterpart connector at each of front sides thereof in a fitting direction in which the connector and the counterpart connector approach to each other. The connector includes: a housing having a connection portion which is connected to the counterpart connector; and a slider which is held in the housing to be movable in the fitting direction, and which is energized toward the front side of the connector in the fitting direction with an energizing member, the slider being configured to apply a force to the front side of the connector in the fitting direction due to an energizing force of the energizing member by abutting on the counterpart connector during a fitting operation to the counterpart connector. The housing and the slider include: a guide mechanism configured to guide a movement of the slider to the housing in the fitting direction; and a stopper mechanism configured to prevent the slider from being detached from the housing to the front side of the connector in the fitting direction. The guide mechanism has: a pair of ribs provided in one of the housing and the slider, the ribs being provided on opposite sides in a width direction orthogonal to the fitting direction in the one of the housing and the slider, the ribs extending in the fitting direction in the one of the housing and the slider; and a pair of grooves provided in the other of the housing and the slider, the grooves being provided on opposite sides in the width direction in the other of the housing and the slider, the grooves extending in the fitting direction to engage with the pair of ribs in the other of the housing and the slider. The stopper mechanism is provided at a location adjacent to an end part of the guide mechanism at the front side of the connector in the fitting direction.

According to a second illustrative aspect of the present disclosure, wherein the guide mechanism has a structure configured such that: when mounting the slider on the housing, the slider is displaced from an appropriate location at which the grooves and the ribs are appropriately fitted with each other, with respect to the housing, to one side in an up-and-down direction orthogonal to the fitting direction and the width direction; and the slider receives a force in the width direction from an abutting place between the slider and the housing due to a fact that the grooves and the ribs are not fitted to each other when displacing the slider, whereby an elastic restoring force of the slider gives the slider a force toward the other side in the up-and-down direction at the abutting place, when opposite side portions of the slider in the width direction are elastically deformed to be displaced in the width direction.

According to a third illustrative aspect of the present disclosure, the guide mechanism includes: the pair of ribs provided, in the housing, on the opposite sides in the width direction; and the pair of grooves provided, in the slider, on the opposite sides in the width direction. The structure includes a tapered surface formed on a top surface of each of the ribs, the top surface serving as the abutting place. The tapered surface is inclined to be located inwardly in the width direction as going toward the other side in the up-and-down direction.

According to a fourth illustrative aspect of the present disclosure, the connector and the counterpart connector are electrical connectors of an in-vehicle airbag system, the counterpart connector corresponding to a connector at a side of an inflator provided in the inflator of the airbag system, the connector corresponding to a connector at a side of a wire harness which supplies a control signal to the inflator.

In the connector according to the first aspect of the present disclosure, since the guide mechanism is formed in such a manner that the pair of ribs and the pair of grooves extending in the fitting direction are engaged with each other, the slider can be stably moved in the fitting direction with respect to the housing. Since the stopper mechanism for preventing the slider from being detached from the housing to the front side in the fitting direction is provided at a location where the rigidity adjacent to the end part on the front side in the fitting direction of the guide mechanism is extremely high, even when moment rotating with the width direction as an axis acts on the slider, a state where the slider is detached from the housing by breaking through the stopper mechanism is extremely hard to occur.

In the connector according to the second aspect of the present disclosure, in a state where the slider is displaced to one side in the up and down direction from the appropriate location that coincides with the fitting of the groove and the rib with respect to the housing, a force toward the other side in the up and down direction is automatically venerated in the slider when the slider is caused to be mounted on the housing. Therefore, the slider can be automatically assembled thereto at the appropriate location where the groove and the rib are fitted to each other simply by pushing the slider to the rear side in the fitting direction with respect to the housing. Therefore, when the slider is mounted on the housing, in the state where the slider is displaced to one side in the up and down direction from the appropriate location that coincides with the fitting of the groove and the rib with respect to the housing due to a surrounding situation, the slider can be automatically assembled thereto at the appropriate location simply by pushing the slider to the rear side in the fitting direction with respect to the housing when it is required to mount the slider on the housing.

In the connector according to the third aspect of the present disclosure, the structure can be realized with a simple structure in which the tapered surface is formed on the top surface of the rib.

In the connector according to the fourth aspect of the present disclosure, with respect to the connector used in the airbag system, the slider can be stably moved in the fitting direction with respect to the housing, and even when the moment rotating with the width direction as the axis acts on the slider, the state where the slider is detached from the housing by breaking through the stopper mechanism can be extremely hard to occur.

According to the present disclosure, it is possible to provide a connector not only capable of stably moving a slider in a fitting direction with respect to a housing, but also capable of preventing a state, as much as possible, in which the slider is detached from the housing by breaking through a stopper mechanism.

Hereinabove, the present disclosure is briefly described. Details of the present disclosure will be further clarified by reading through a mode for implementing the disclosure to be described below (hereinafter, referred to as an "embodiment") with reference to the accompanying drawings.

DESCRIPTION OF EMBODIMENTS

Figure 1:
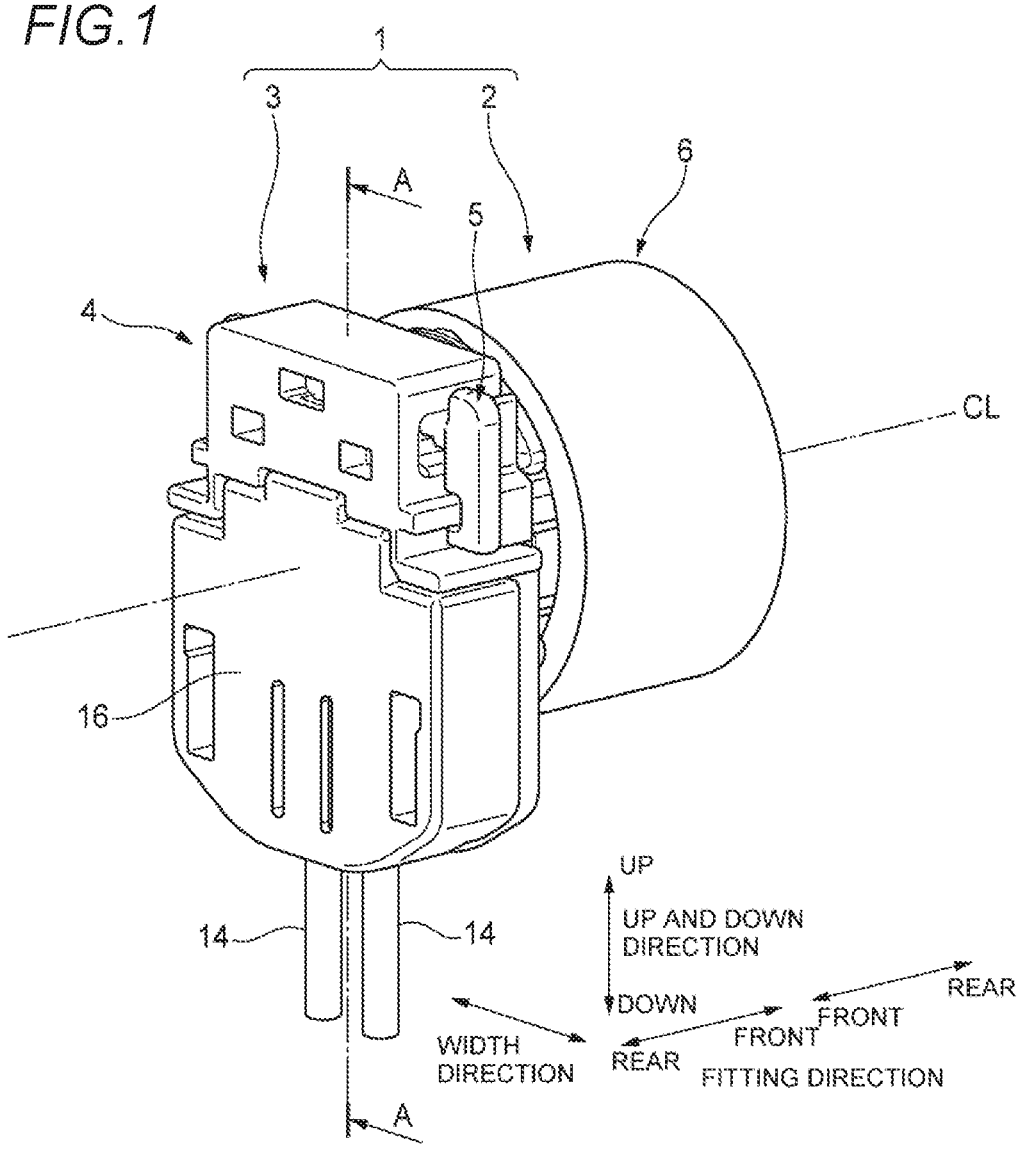
FIG. 1 is a perspective view of a connector connection structure according to an embodiment of the present disclosure.
Figure 2:
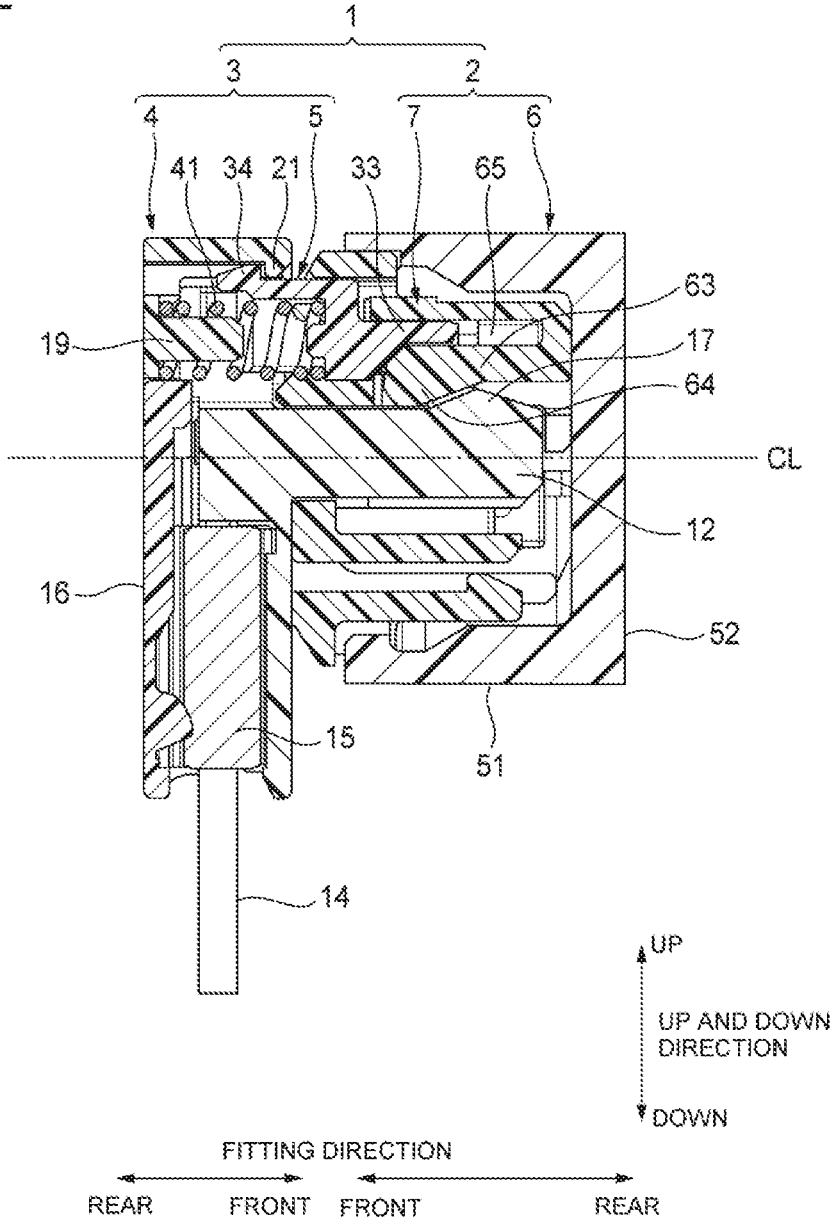
FIG. 2 is a cross-sectional view taken along the line A-A in FIG. 1.

Hereinafter, a connector connection structure 1 including a second connector 3 according to an embodiment of the present disclosure will be described with reference to the drawings. As illustrated in FIGS. 1 and 2, the connector connection structure 1 is a structure in which the second connector 3 according to the embodiment of the present disclosure and a first connector 2 which is a counterpart connector are fitted to each other.

Figure 3:
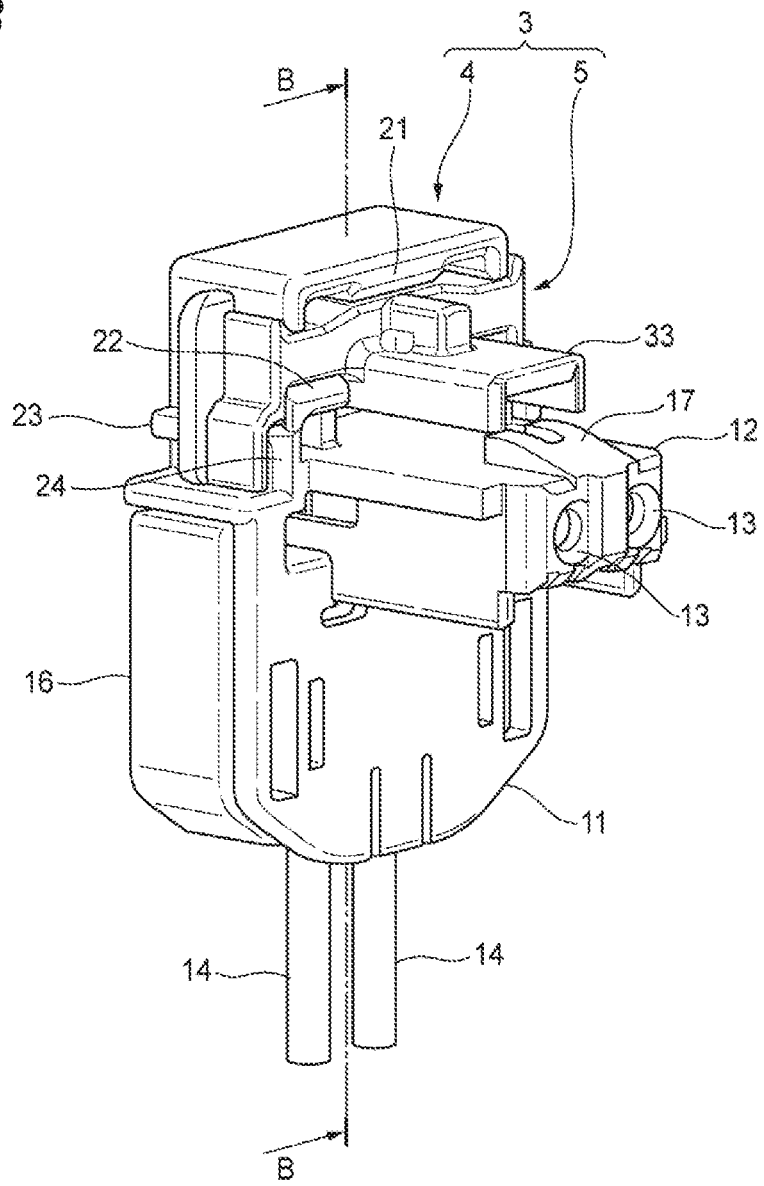
FIG. 3 is a perspective view of a second connector illustrated in FIG. 1.
Figure 4:
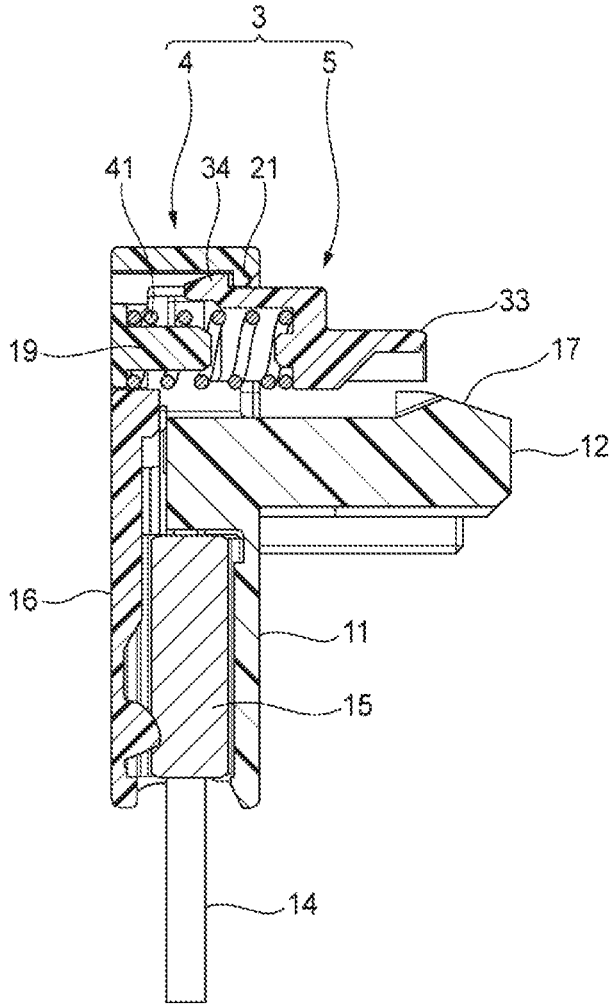
FIG. 4 is a cross-sectional view taken along line B-B in FIG. 3.
Figure 5:
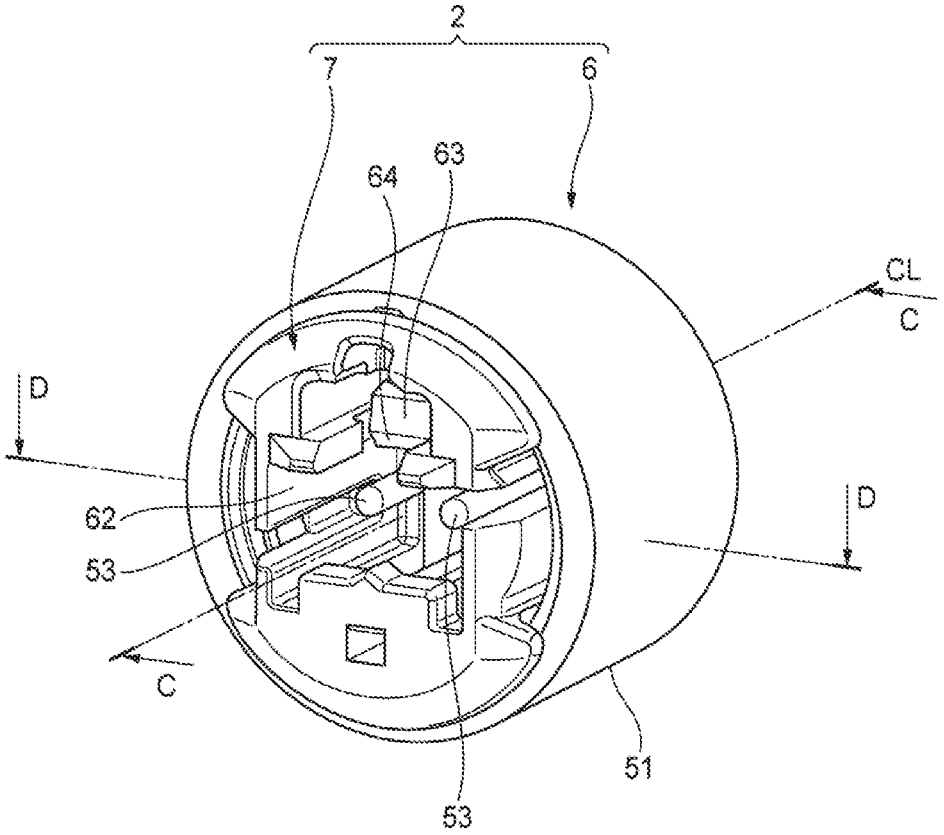
FIG. 5 is a perspective view of a first connector illustrated in FIG. 1.
Figure 6:
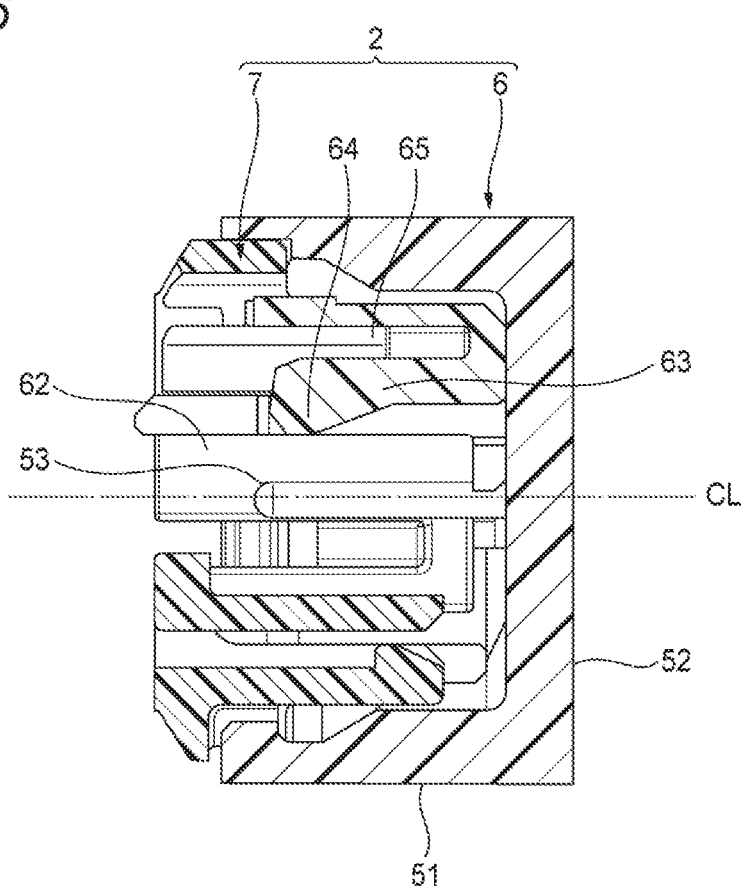
FIG. 6 is a cross-sectional view taken along the line C-C in FIG. 5.
Figure 7:
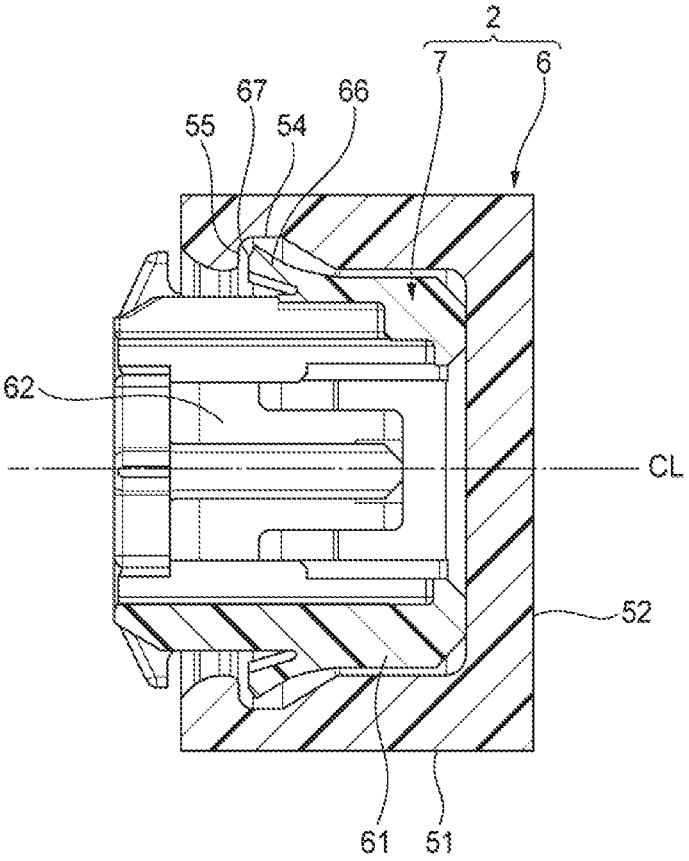
FIG. 7 is a cross-sectional view taken along line D-D in FIG. 5.

The connector connection structure 1 is typically used for an in-vehicle airbag system. Here, the first connector 2 illustrated in FIGS. 5 to 7 is a connector on the inflator side provided in an inflator of the airbag system, and the second connector 3 illustrated in FIGS. 3 and 4 is a connector on the wire harness side that supplies a control signal to the inflator. The connector connection structure 1 is obtained in such a manner that a fitting port 62 of the first connector 2 (refer to FIG. 5) and the connection portion 12 of the second connector 3 (refer to FIG. 3) are fitted to each other.

For the convenience of description, as illustrated in FIGS. 1 and 2, a "fitting direction", a "width direction", an "up and down direction", "front", "rear", "up", and "down" are defined. The "fitting direction", the "width direction", and the "up and down direction" are orthogonal to each other. A front and rear direction of the fitting direction on the side of the first connector 2 is opposite to a front and rear direction of the fitting direction on the side of the second connector 3, and in any of the first and second connectors 2 and 3, the front side in the fitting direction is defined as the front side, and the back side in the fitting direction is defined as the rear side.

First, a configuration of the second connector 3 illustrated in FIGS. 3 and 4 will be described. As illustrated in FIGS. 3 and 4, the second connector 3 includes a housing 4 and a slider 5. The slider 5 is a component slidably mounted on the housing 4 in the fitting direction.

Figure 8A:
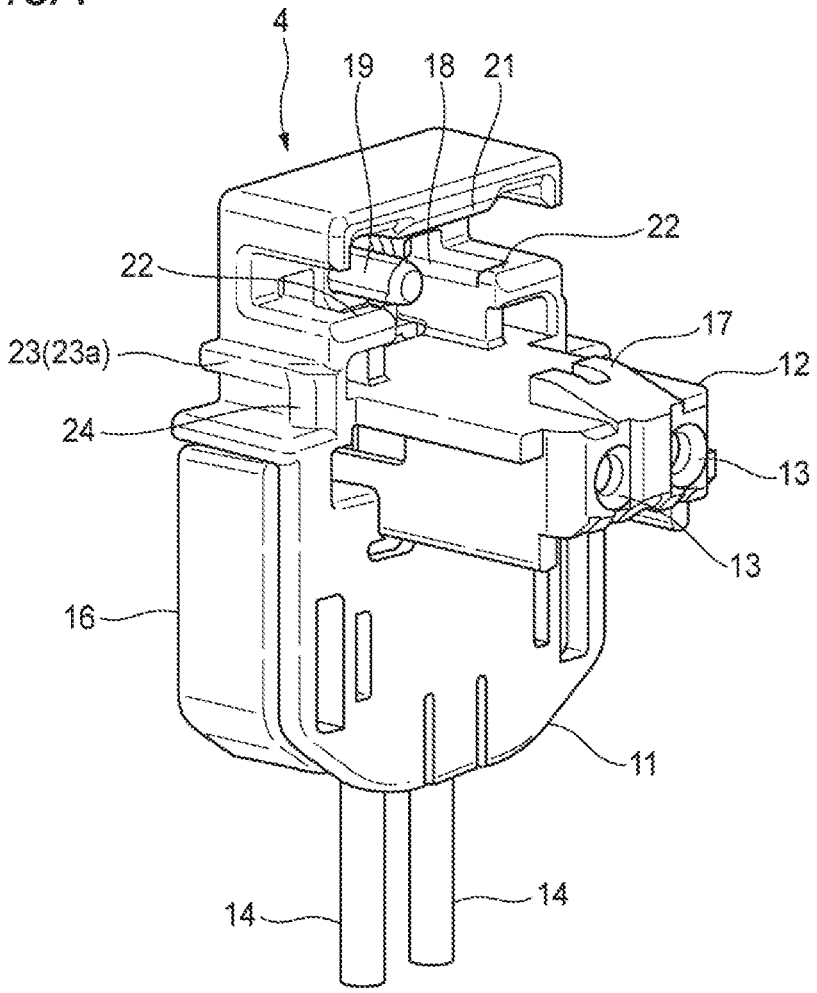
FIG. 8A is a perspective view of a housing illustrated in FIG. 3.

First, the housing 4 will be described. As illustrated in FIG. 8A, the resin housing 4 integrally includes an approximately rectangular parallelepiped main body portion 11 extending in the up and down direction, and an approximately rectangular parallelepiped connection portion 12 protruding from an approximately center portion in the up and down direction of the main body portion 11 to the front side in the fitting direction.

A pair of terminal housing chambers 13 that are opened to the front side in the fitting direction are formed to be arranged in the width direction in the connection portion 12. A pair of metallic female terminals (not illustrated) are housed inside the pair of terminal housing chambers 13. When the first and second connectors 2 and 3 are fitted to each other, the pair of female terminals are electrically connected to a pair of male terminals 53 on the side of the first connector 2 (refer to FIG. 5).

A pair of electric wires 14 are connected to the rear side in the fitting direction of the pair of female terminals. The pair of electric wires 14 connected to the pair of female terminals extend downward inside the main body portion 11, and extend downward from a lower end surface of the main body portion 11. The pair of electric wires 14 extending from the main body portion 11 are connected to a control portion (not illustrated) of the airbag system.

A ferrite core 15 (refer to FIG. 4) is mounted on the pair of electric wires 14 located inside the main body portion 11. Accordingly, a noise current caused by various electromagnetic waves from the outside is prevented from flowing through the pair of electric wires 14. A resin cover 16 is assembled to the main body portion 11 from the rear side in the fitting direction to cover the pair of electric wires 14 on which the ferrite core 15 is mounted.

A protruding portion 17 protruding upward is provided on the tip side of an upper surface of the connection portion 12. The protruding portion 17 has a function of maintaining a fitted state of the first and second connectors 2 and 3 (described later) by engaging with a protruding portion 64 of a fitting arm 63 on the side of the first connector 2 (refer to FIG. 2).

In an upper portion of the main body portion 11 (a portion located on the upper side of the connection portion 12), a slider mounting space 18 which is a recessed portion for mounting the slider 5 is formed to be opened on the front side in the fitting direction and on the opposite sides in the width direction. A column portion 19 extending toward the front side in the fitting direction is provided at a center portion in the width direction of the wall surface of the main body portion 11 that defines the rear side surface in the fitting direction of the slider mounting space 18. The column portion 19 is used to hold an end portion on the rear side in the fitting direction of a coil spring 41 that energizes the slider 5 (refer to FIG. 10).

A stopper portion 21 protruding downward is formed at a center portion in the width direction of a front edge in the fitting direction on the wall surface of the main body portion 11 that defines an upper surface of the slider mounting space 18; and a pair of stopper portions 22 protruding upward are formed on opposite side portions in the width direction of the front edge in the fitting direction on the wall surface of the main body portion 11 that defines a lower surface of the slider mounting space 18.

Figure 8B:
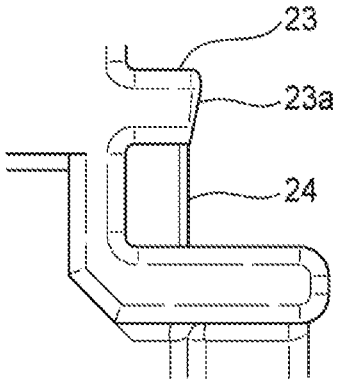
FIG. 8B is an enlarged view of a rib and a stopper portion in FIG. 8A when viewed from the rear side in a fitting direction.

A pair of ribs 23 protruding outward in the width direction and extending in the fitting direction are formed on opposite side surfaces in the width direction of an approximately center portion in the up and down direction of the main body portion 11 (a portion located below the slider mounting space 18). As illustrated in FIG. 8B, a top surface of the rib 23 is formed with a tapered surface 23*a* that is inclined to be located inside in the width direction as going downward in the up and down direction. Action of the tapered surface 23*a* will be described later.

Even at end portions on the front side in the fitting direction of the pair of ribs 23, a pair of stopper portions 24 protruding outward in the width direction are formed at a location adjacent to the lower side of the end portions. Hereinabove, the housing 4 is described.

Figure 9A:
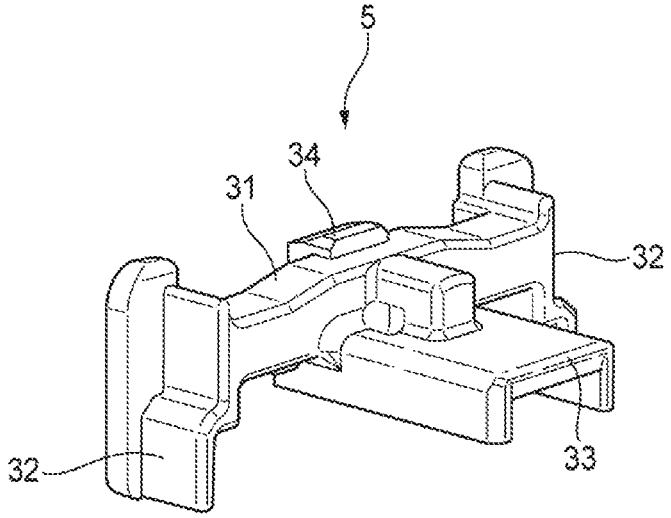
FIG. 9A is a perspective view of a slider illustrated in FIG. 3.
Figure 9B:
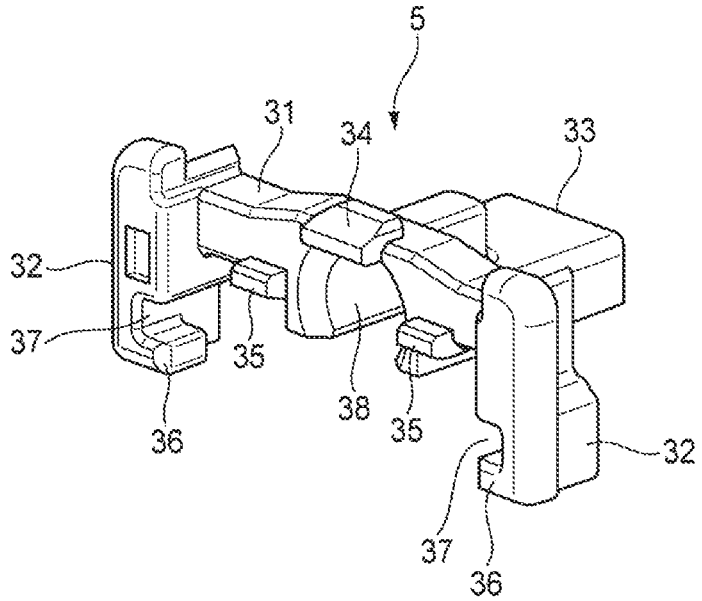
FIG. 9B is a perspective view of the slider viewed from a different direction.

Next, the slider 5 will be described. As illustrated in FIGS. 9A and 9B, the resin slider 5 integrally includes a main body portion 31 extending in the width direction, a pair of hanging portions 32 extending downwardly from opposite end portions in the width direction of the main body portion 31, and a protruding piece 33 protruding from a center portion in the width direction of the main body portion 31 to the front side in the fitting direction.

A protruding portion 34 protruding upward is formed (refer to FIGS. 9A and 9B) at a center portion in the width direction of the rear edge in the fitting direction on an upper surface of the main body portion 31, and a pair of protruding portions 35 protruding downward are formed on opposite side portions in the width direction of the rear edge in the fitting direction on a lower surface of the main body portion 31 (refer to FIG. 9B), The protruding portion 34 and the pair of protruding portions 35 are respectively engaged with the stopper portion 21 and the pair of stopper portions 22 on the side of the housing 4, thereby having a function of preventing the slider 5 from being detached from the housing 4 to the front side in the fitting direction.

A pair of protruding portion 36 protruding inward in the width direction are formed at lower end portions on the inner side surfaces in the width direction of the pair of the hanging portions 32 (refer to FIG. 9B). As a result, a pair of groove portions 37 that are recessed outward in the width direction and extend in the fitting direction are formed on the inner side surfaces in the width direction of the pair of hanging portions 32 (refer to FIG. 9B). The pair of ribs 23 on the side of the housing 4 are fitted to the pair of groove portions 37, whereby the movement in the fitting direction of the slider 5 with respect to the housing 4 is guided. The pair of protruding portions 36 are engaged with the pair of stopper portions 24 on the side of the housing 4, thereby having a function of preventing the slider 5 from being detached from the housing 4 to the front side in the fitting direction.

A recessed portion 38 that is recessed toward the front side in the fitting direction is provided at a center portion in the width direction on the rear side surface in the fitting direction of the main body portion 31. The recessed portion 38 is used to hold a front end portion in the fitting direction of the coil spring 41 for energizing the slider 5 (refer to FIG. 10). Hereinabove, the slider 5 is described.

Figure 10:
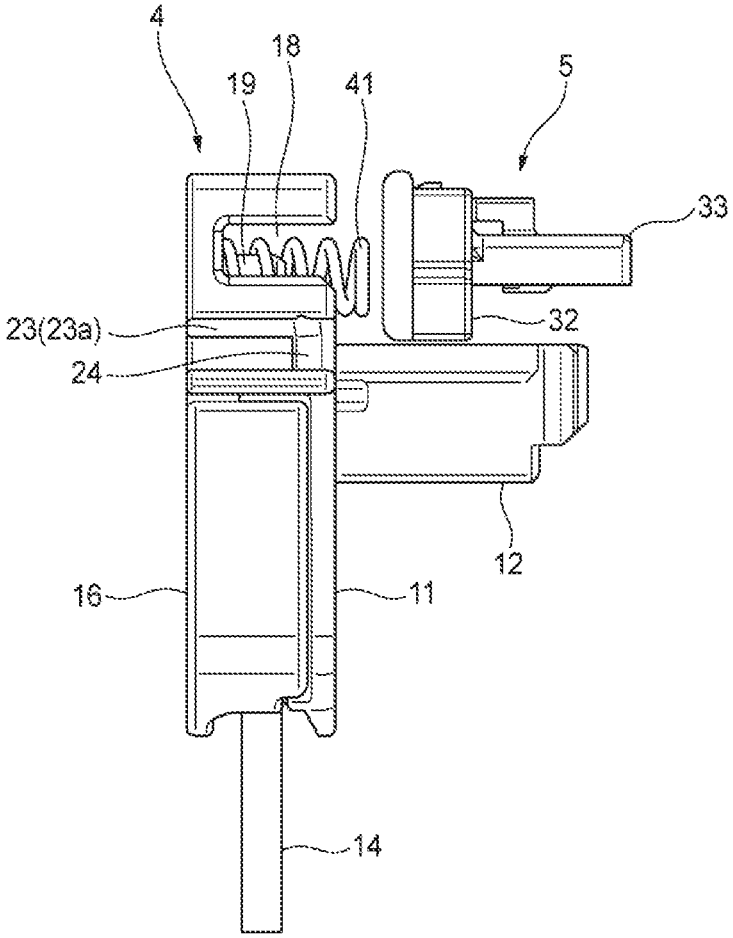
FIG. 10 is a side view illustrating a state when the slider is assembled to the housing.

Next, the assembly of the slider 5 to the housing 4 will be described with reference to FIGS. 10 to 12. As illustrated in FIG. 10, first, a rear end portion in the fitting direction of the coil spring 41 is inserted into the column portion 19 of the housing 4, after Which the slider 5 is caused to be close toward the slider mounting space 18 of the housing 4 from the front side in the fitting direction, and the front end portion in the fitting direction of the coil spring 41 is inserted into the recessed portion 38 of the slider 5. The insertion order of opposite end portions of the coil spring 41 may be reversed.

Next, the slider 5 is further moved to be closer toward the slider mounting space 18 while resisting the energizing force of the coil spring 41, and the pair of groove portions 37 of the slider 5 are fitted to the pair of ribs 23 on the side of the housing 4. Here, in the present example, as illustrated in FIG. 11, the slider 5 is displaced upward from an appropriate location that coincides with the fitting of the groove portion 37 and the rib 23 with respect to the housing 4, and in a state where the pair of protruding portions 36 of the slider 5 are in contact with the tapered surfaces 23*a* of the pair of ribs 23, the slider 5 is simply pushed into the rear side in the fitting direction with respect to the housing 4, whereby, as illustrated in FIG. 12, the slider 5 can be automatically assembled thereto at the appropriate location where the groove portion 37 and the rib 23 are fitted to each other.

Figure 11:
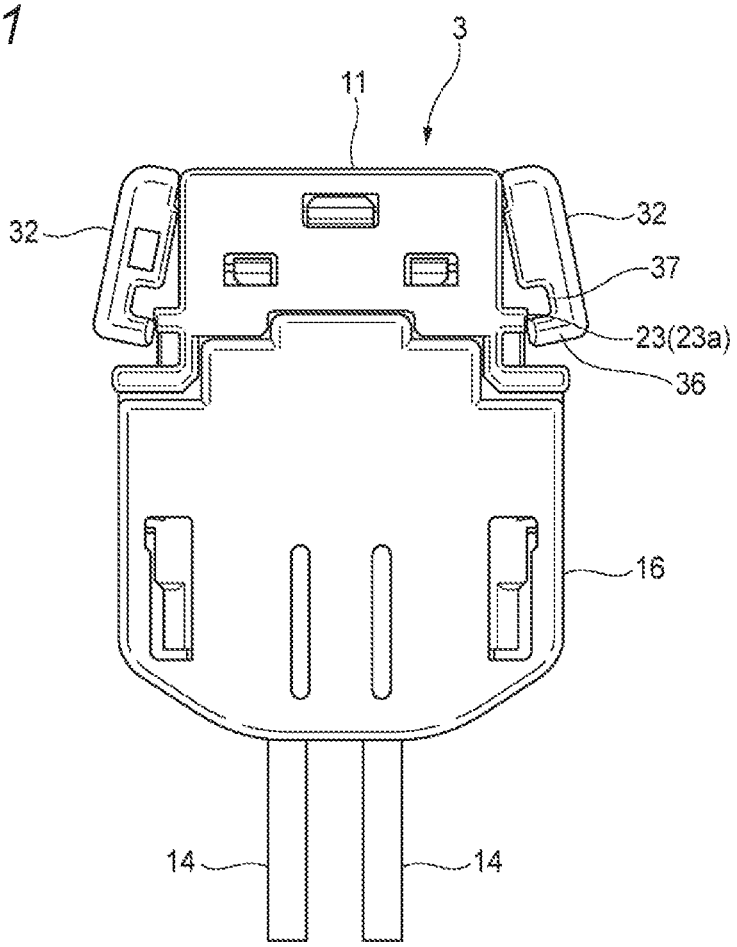
FIG. 11 is a rear view illustrating an intermediate stage of assembling the slider to the housing.
Figure 12:
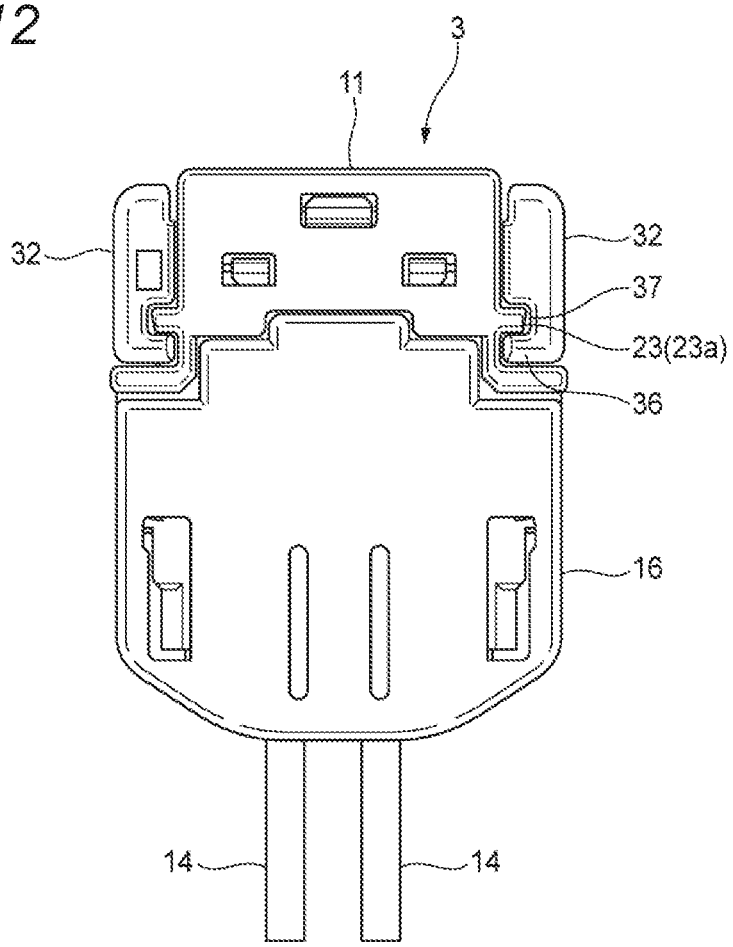
FIG. 12 is a rear view illustrating a stage in which the assembly of the slider to the housing is completed.

That is, as illustrated in FIG. 11, in the state where the pair of protruding portions 36 of the slider 5 are in contact with the tapered surfaces 23*a* of the pair of ribs 23, the pair of protruding portions 36 receive a force outward in the width direction from the tapered surfaces 23*a* of the pair of ribs 23 due to a fact that the groove portion 37 and the rib 23 are not fitted to each other, such that the pair of hanging portions 32 of the slider 5 are in a state of being elastically deformed to be displaced outward in the width direction. The pair of protruding portions 36 press the tapered surfaces 23*a* of the pair of ribs 23 toward the inside in the width direction by an elastic restoring force of the slider 5 elastically deformed as described above.

Here, due to the fact that the tapered surface 23*a* is inclined to be located inside in the width direction as going downward in the up and down direction, a portion of the force by which the pair of protruding portions 36 press the tapered surfaces 23*a* of the ribs 23 acts as a downward force for causing the pair of protruding portions 36 (therefore, the slider 5) to move downward. As a result, in the state where the pair of protruding portions 36 are in contact with the tapered surfaces 23*a* of the pair of ribs 23, when the slider 5 is pushed to the rear side in the fitting direction with respect to the housing 4, the slider 5 receives the downward force and is automatically displaced downward, whereby, as illustrated in FIG. 12, the slider 5 can be automatically assembled thereto at the appropriate location where the groove portion 37 and the rib 23 are fitted to each other.

As described above, after the pair of grooves 37 of the slider 5 are fitted to the pair of ribs 23 on the side of the housing 4 while resisting the energizing force of the coil spring 41, when the force applied to the slider 5 is released, the slider 5 moves to the front side in the fitting direction with respect to the housing 4 by receiving the energizing force of the coil spring 41, after which the protruding portion 34 and the pair of protruding portions 35 of the slider 5 are respectively engaged with the stopper portion 21 and the pair of stopper portions 22 on the side of the housing 4, and the pair of protruding portions 36 of the slider 5 are engaged with the pair of stopper portions 24 on the side of the housing 4. The above-described engagement prevents the slider 5 from being detached from the housing 4 to the front side in the fitting direction.

As described above, the assembly of the slider 5 to the housing 4 is completed, and the second connector 3 illustrated in FIGS. 3 and 4 is obtained. In a state where the assembly of the slider 5 to the housing 4 is completed, the slider 5 is held in the housing 4 to be slidable in the fitting direction with respect to the housing 4 in a state of being always energized to the front side in the fining direction by the energizing force of the coil spring 41. When the first and second connectors 2 and 3 are fitted to each other, the slider 5 is located above a center axial line CL of a holder 6 (described later) of the first connector 2 (refer to FIG. 2)

As described above, in the second connector 3 according the embodiments of the present disclosure, the pair of ribs 23 extending in the fitting direction are engaged with the pair of groove portions 37, whereby the slider 5 can be stably moved in the fitting direction with respect to the housing 4. Since the stopper portion 24 that prevents the slider 5 from being detached from the housing 4 to the front side in the fitting direction is provided at a location where the rigidity adjacent to the end portion on the front side in the fitting direction of the rib 23 is extremely high, even when moment rotating with the width direction as an axis acts on the slider 5, a state where the slider 5 is detached from the housing 4 by breaking through the stopper portion 24 is extremely hard to occur.

Next, the first connector 2, which is the counterpart connector, illustrated in FIGS. 5 to 7 will be described. As illustrated in FIGS. 5 to 7, the first connector 2 includes the holder 6 and a shunt ring 7 assembled to the holder 6. The holder 6 is mounted on an ignition terminal portion provided on an airbag inflator.

Figure 13A:
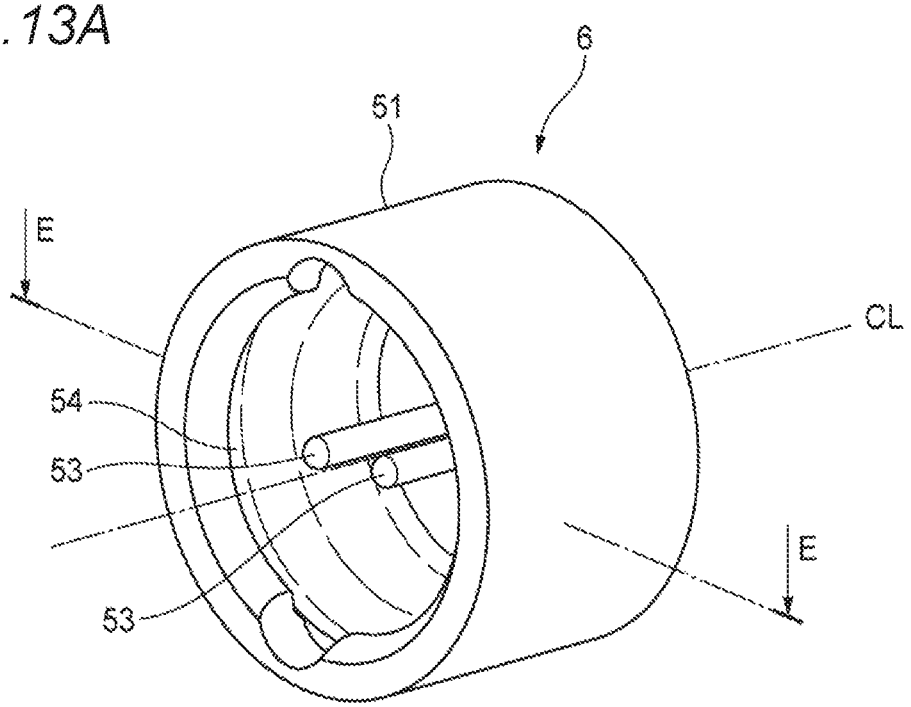
FIG. 13A is a perspective view of a holder illustrated in FIG. 5.
Figure 13B:
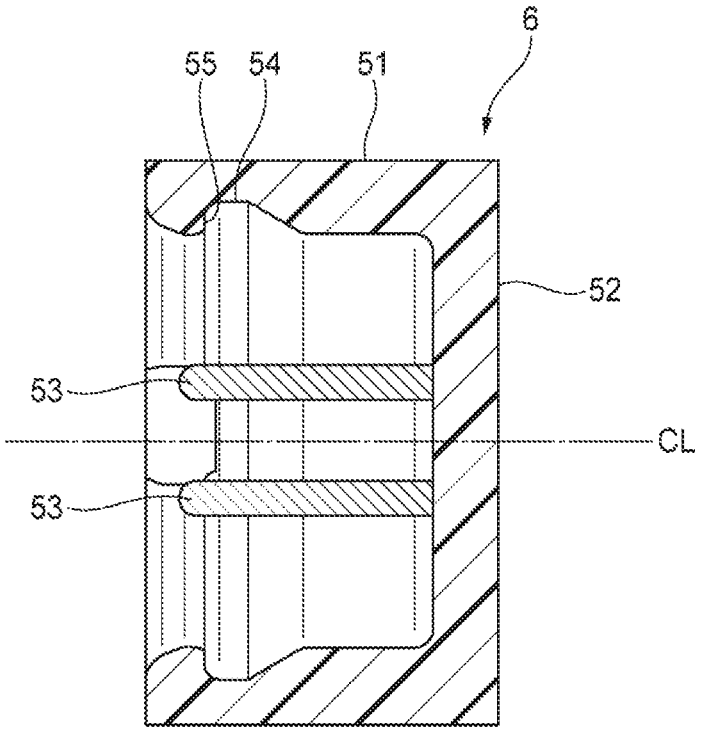
FIG. 13B is a cross-sectional view taken along the line E-E in FIG. 13A.
Figure 14A:
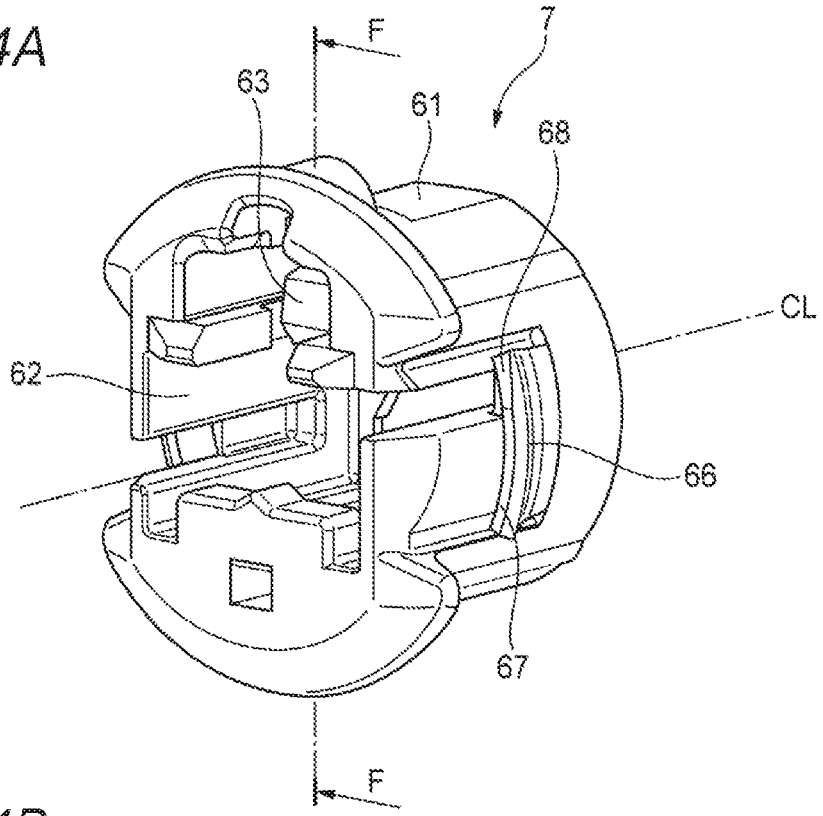
FIG. 14A is a perspective view of a shunt ring illustrated in FIG. 5.
Figure 14B:
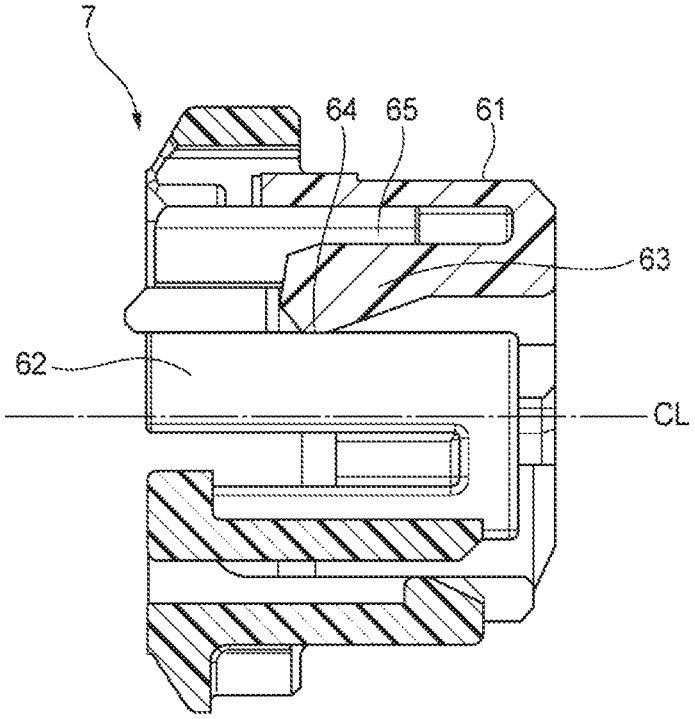
FIG. 14B is a cross-sectional view taken along the line F-F in FIG. 14A.

First, the holder 6 will be described. As illustrated in FIGS. 13A and 13B, the resin holder 6 integrally includes a cylindrical-shaped cylindrical portion 51 having the center axial line CL and a disk-shaped bottom portion 52 that closes an opening on the rear side in the fitting direction of the cylindrical portion 51. The front side in the fitting direction of the cylindrical portion 51 is opened.

In the internal space of the holder 6, the pair of metallic male terminals 53 extending from the bottom portion 52 toward the front side in the fitting direction are provided to be arranged in the width direction. The pair of male terminals 53 are connected to a circuit on the inflator side of the airbag system.

In the inner periphery of a portion on the front side in the fitting direction of the cylindrical portion 51, an annular groove portion 54 recessed outward in a radial direction is formed to extend in a plane perpendicular to the center axial line CL (refer to FIG. 13B). The portion on the front side in the fitting direction on the inner wall surface of the annular groove portion 54 forms a ring-shaped abutting surface 55 facing the rear side in the fitting direction. Therefore, portions of the ring-shaped abutting surface 55, which are located on opposite sides in the width direction, extend in the up and down direction. As such, the portions of the abutting surface 55 facing the rear side in the fitting direction, which are located on the opposite sides in the width direction and extend in the up and down direction, are formed to abut on a tip surface 67 of a pair of locking arm portions 66 (described later) of the shunt ring 7. Hereinabove, the holder 6 is described.

Next, the shunt ring 7 will be described. As illustrated in FIGS. 14A to 15B, the resin shunt ring 7 includes an approximately cylindrical main body portion 61. The fitting port 62 that is opened to the front side in the fitting direction is formed inside the main body portion 61. The connection portion 12 of the second connector 3 (refer to FIG. 3) is inserted into the fitting port 62.

The main body portion 61 is integrally provided with a cantilever-shaped fitting arm 63 that enters the internal space of the main body portion 61 from an upper end portion of a rear end portion in the fitting direction and extends toward the front side in the fitting direction. The fitting arm 63 is located facing the upper side of the fitting port 62. A protruding portion 64 protruding downward (that is, toward the inside of the fitting port 62) is formed at a tip portion of the fitting arm 63 (an end portion on the front side in the fitting direction). Between the fitting arm 63 and the inner surface of a portion on the upper side of the main body portion 61, a space 65 that is opened to the front side in the fitting direction and is spaced apart in the up and down direction is formed to extend in the fitting direction. The protruding piece 33 of the slider 5 on the side of the second connector 3 is inserted into the space 65 when the first and second connectors 2 and 3 are fitted to each other (refer to FIG. 2).

Figure 15A:
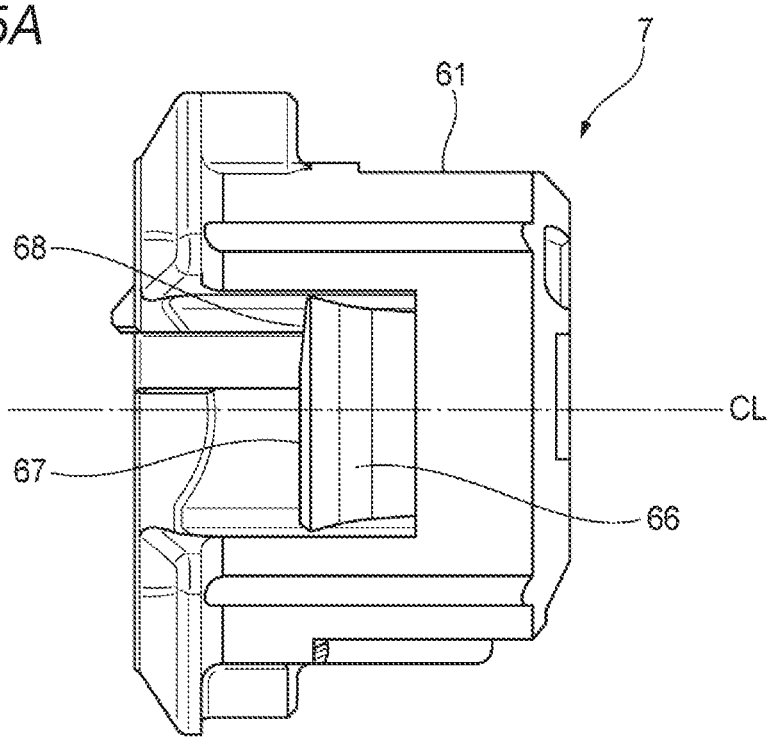
FIG. 15A is a side view of the shunt ring.

The pair of locking arm portions 66 protruding from an outer periphery and extending to the front side in the fitting direction are integrally formed at portions located on opposite sides in the width direction in the outer periphery of the main body portion 61 (also refer to FIG. 7), As illustrated in FIG. 15A, the locking arm portion 66 has a shape that is approximately symmetrical up and down with respect to the center axial line CL when viewed from the width direction.

Figure 15B:
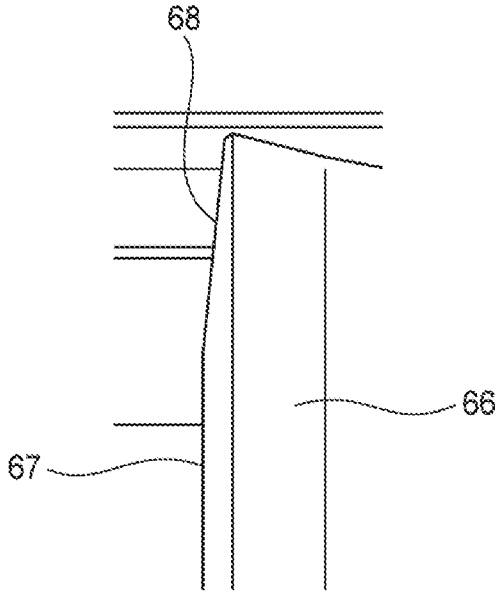
FIG. 15B is an enlarged view of a tapered surface provided on a locking arm of the shunt ring.

The tip surface 67, which is a plane extending in the up and down direction and facing the front side in the fitting direction, is formed at a tip portion of the locking arm portion 66 (an end portion on the front side in the fitting direction) (also refer to FIG. 7). However, as illustrated in FIG. 15B, in an upper region of the tip surface 67 extending in the up and down direction (a region above the center axial line CL), a tapered surface 68 is formed to be inclined to be located on the rear side in the fitting direction as approaching an upper end of the tip surface 67. Action of the tapered surface 68 will be described later. Hereinabove, the shunt ring 7 is described.

Figure 16A:
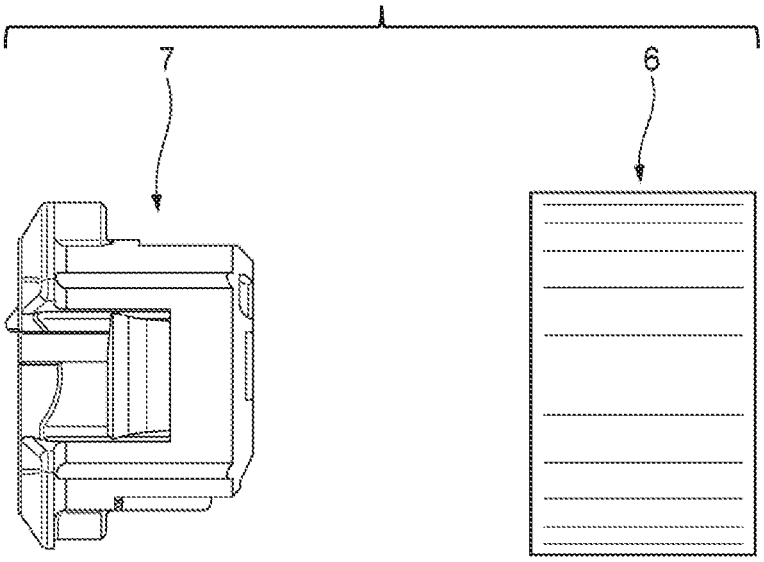
FIG. 16A is a side view illustrating a state when the shunt ring is assembled to the holder.

As illustrated in FIG. 16A, the shunt ring 7 is assembled to the holder 6 by being fitted to the internal space of the holder 6 from the opening on the front side in the fitting direction of the holder 6. In the process, the pair of locking arm portions 66 of the shunt ring 7 are temporarily elastically deformed inward in the width direction after abutting on an inner peripheral surface of the holder 6. When the tip portions thereof reach the annular groove portions 54 of the holder 6, the pair of locking arm portions 66 are elastically returned, and the tip portions thereof enter the annular groove portions 54. Accordingly, the assembly of the shunt ring 7 to the holder 6 is completed, and the first connector 2 illustrated in FIGS. 5 to 7 is obtained.

In a state where the assembly of the shunt ring 7 to the holder 6 is completed, as illustrated in FIG. 7, the tip surfaces 67 of the pair of locking arm portions 66 extending in the up and down direction facing the front side in the fitting direction, and the abutting surfaces 55 extending in the up and down direction facing the rear side in the fitting direction abut on each other in the fitting direction. As a result, the shunt ring 7 is prevented from being detached from the holder 6 to the front side in the fitting direction.

Figure 16B:
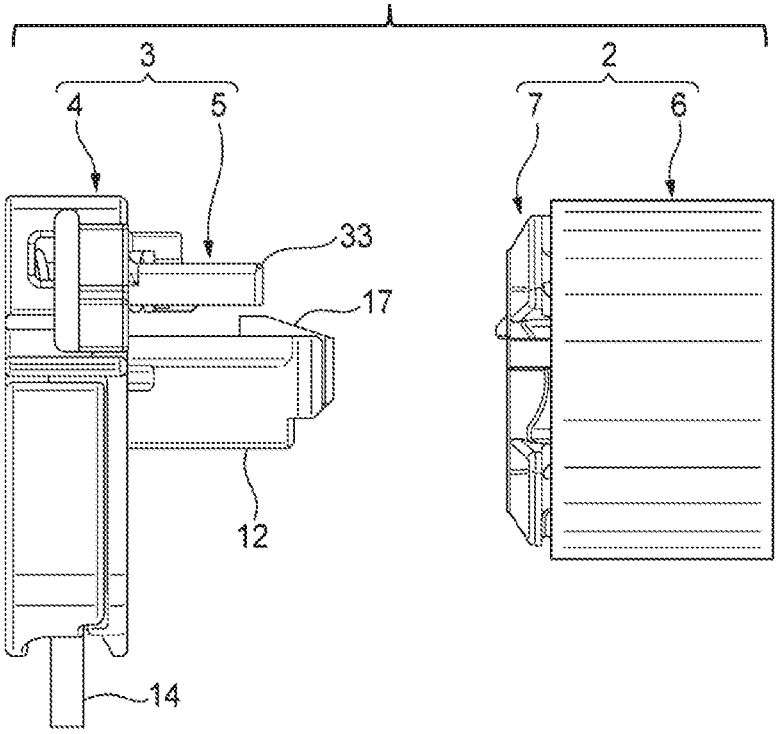
FIG. 16B is a side view illustrating a state when the first connector and the second connector are fitted to each other.

Next, a fitting operation of the first connector 2 and the second connector 3 will be described with reference to FIG. 2. In order to cause the first and second connectors 2 and 3 to be fitted to each other, as illustrated in FIG. 16B, the first and second connectors 2 and 3 are caused to be relatively close to each other in the fitting direction, and the connection portion 12 of the second connector 3 is inserted into the fitting port 62 of the first connector 2.

When the connection portion 12 is inserted into the fitting port 62, first, the protruding portion 64 of the fitting arm 63 abuts on the protruding portion 17 of the connection portion 12 and rides on the protruding portion 17, whereby the fitting arm 63 is elastically deformed upward. Therefore, the space 65 becomes narrower in the up and down direction, and thus the protruding piece 33 of the slider 5 cannot enter the space 65.

When the insertion proceeds, the tip of the protruding piece 33 of the slider 5 contact the holder 6 and attempts to enter the space 65. However, at the present stage, since the fitting arm 63 is elastically deformed upward, the protruding piece 33 cannot enter the space 65, After the stage where the tip of the protruding piece 33 of the slider 5 contacts the holder 6, the insertion proceeds while the slider 5 resists the energizing force of the coil spring 41 applied to the holder 6 by the contact between the slider 5 and the holder 6.

When the insertion proceeds and the protruding portion 64 rides over the protruding portion 17, the state where the protruding portion 64 and the protruding portion 17 are locked can be obtained by causing the fitting arm 63 to be elastically returned downward. The space 65 is widened in the up and down direction by the elastic return of the fitting arm 63, and thus the protruding piece 33 of the slider 5 can enter. Therefore, the slider 5 slides to the front side in the fitting direction with respect to the housing 4 by the energizing force of the coil spring 41, and the protruding piece 33 enters the space 65. Accordingly, the fitting operation of the first and second connectors 2 and 3 is completed, and the connector connection structure 1 illustrated in FIG. 2 can be obtained.

In a state where the fitting operation of the first and second connectors 2 and 3 is completed, the protruding piece 33 of the slider 5 is inserted into the space 65, whereby the fitting arm 63 cannot be elastically deformed upward (that is, in a direction of releasing the locking between the protruding portion 64 and the protruding portion 17). Therefore, a locked state between the protruding portion 64 and the protruding portion 17 (that is, the fitted state of the first and second connectors 2 and 3) can be firmly maintained. As illustrated in FIG. 2, when the first and second connectors 2 and 3 are fitted to each other, a locking place between the protruding portion 64 and the protruding portion 17 (locking mechanism) is located above the center axial line CL of the holder 6 of the first connector 2.

As described above, in the incompletely fitted state of the first and second connectors 2 and 3, the slider 5 acts to keep the front sides in the fitting direction of the first and second connectors 2 and 3 apart from each other by the energizing force of the coil spring 41. Therefore, it is easy to detect an abnormality in the incompletely fitted state. In the completely fitted state of the first and second connectors 2 and 3, the slider 5 is engaged with the fitting arm 63 and prevents the fitting arm 63 from being deformed in the direction of releasing the locking between the protruding portion 64 and the protruding portion 17 is released (a so-called double locking function is performed). Therefore, it is possible to more surely prevent the occurrence of the state where the first and second connectors 2 and 3 are unintentionally separated from each other.

Next, referring to FIG. 17, action and effect of the tapered surface 68 formed on the tip surfaces 67 of the pair of locking arm portions 66 of the shunt ring 7 (refer to FIG. 15B) will be described. When the connector connection structure 1 described above is used in the in-vehicle airbag system, a mode, in which an impact in a direction of separating the first and second connectors 2 and 3 from each other (a direction in which the first and the second connectors 2 and 3 move to the rear side in the fitting direction) is applied to the first and second connectors 2 and 3 fitted to each other due to activation (ignition) of the inflator, may occur.

When the above-described impact mode occurs, a locking mechanism by which the first the main body portion 61 of the shunt ring 7 on the side of the first connector 2 and the connection portion 12 of the housing 4 on the side of the second connector 3 are locked to each other (specifically, a locking mechanism between the protruding portion 64 of the fitting arm 63 and the protruding portion 17 of the connection portion 12) receives an impact in a direction of separating the main body portion 61 and the connection portion 12 from each other (a direction in which the main body portion 61 and the connection portion 12 move to the rear side in the fitting direction) When the locking mechanism receives such an impact, next, the shunt ring 7 receives an impact in a direction of relatively moving to the front side in the fitting direction with respect to the holder 6. When the shunt ring 7 receives such an impact, the tip surfaces 67 of the pair of locking arm portions 66 of the shunt ring 7 receive a reaction force from the abutting surface 55 of the holder 6 to the rear side in the fitting direction.

Here, due to a fact that the locking mechanism is located above the center axial line CL of the cylindrical portion 51 of the holder 6, the shunt ring 7 receives the impact force in a direction of relatively moving to the front side in the fitting direction with respect to the holder 6 at a location separated above the center axial line CL. Therefore, the tip surfaces 67 of the pair of locking arm portions 66 first receive the reaction force from the abutting surface 55 of the holder 6 to the rear side in the fitting direction at a location closer to the upper side in the up and down direction.

Figure 17A:
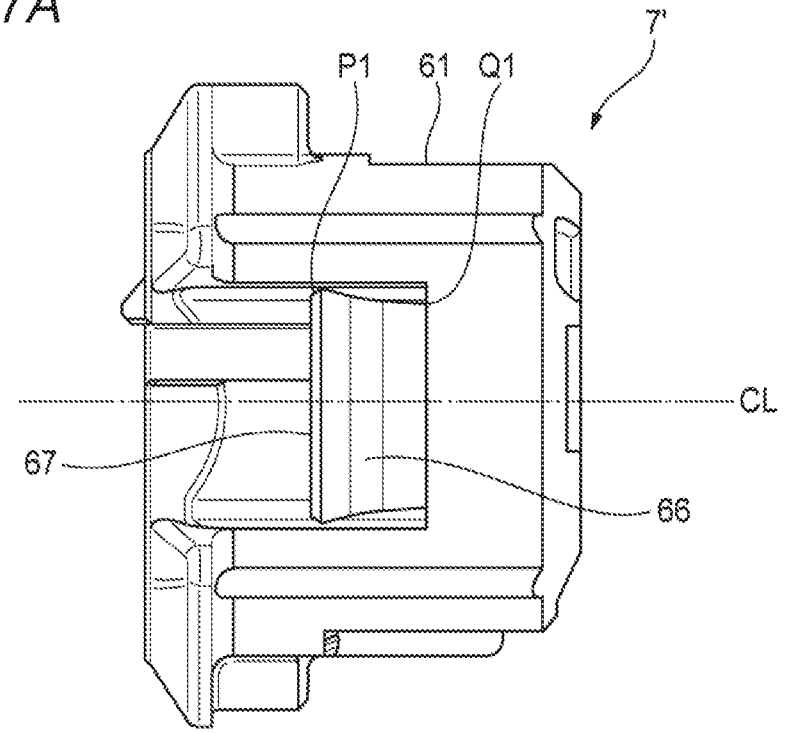
FIG. 17A is a diagram illustrating transmission of a force when an impact acts on a shunt ring according to a comparative example.

Therefore, for example, instead of the shunt ring 7 according to the embodiment, as in a case where a shunt ring 7' according to a comparative example illustrated in FIG. 17A where the tapered surface 68 is not formed is used, when both of the tip surface 67 of the locking arm portion 66 and the abutting surface 55 of the holder 6 have a simple shape extending linearly in the up and down direction over the whole region of a range in the up and down direction in which the both thereof can contact each other, the tip surface 67 of the locking arm portion 66 is easy to first receive the reaction force from the abutting surface 55 at an upper end P1 in the up and down direction. As a result, excessive compressive stress caused by stress concentration is easy to act on an upper end Q1 in the up and down direction at a root part of the locking arm portion 66.

Figure 17B:
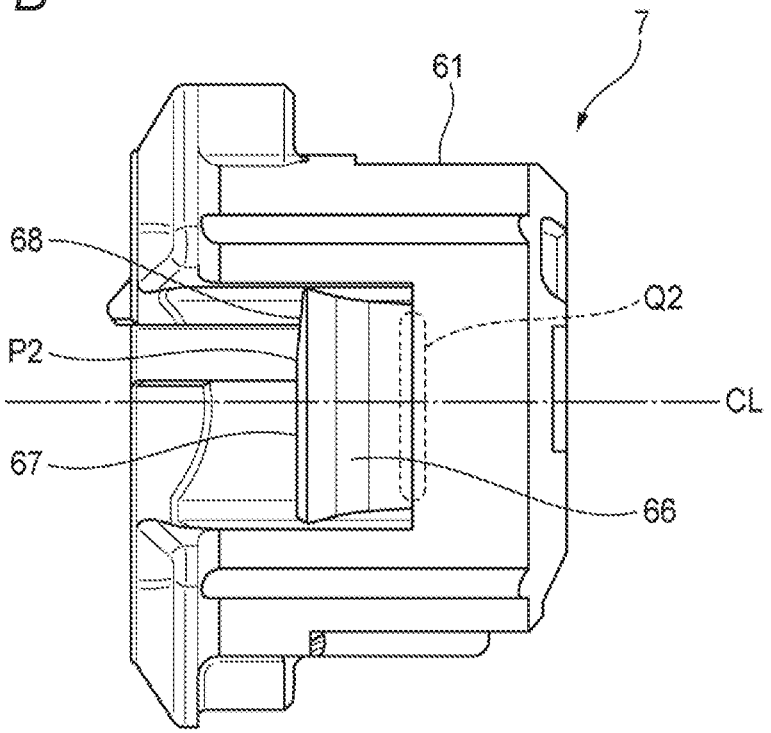
FIG. 17B is a diagram illustrating transmission of a force when an impact acts on the shunt ring according to the embodiment.

On the other hand, as illustrated in FIG. 17B, in the case of using the shunt ring 7 according to the embodiment in which the tapered surface 68 is formed, when the tip surface 67 of the locking arm portion 66 receives the force on the rear side in the fitting direction from the abutting surface 55, the pair of locking arm portions 66 and the abutting surface 55 have a structure in which a place P2 where the tapered surface 68, which is an intermediate place in the up and down direction of the tip surface 67, starts first receives the force from the abutting surface 55. Therefore, in comparison with the comparative example in which only the upper end P1 of the tip surface 67 first receives the force from the abutting surface 55, the compressive stress acting on the root part of the locking arm portion 66 is easy to be dispersed in the up and down direction (refer to a region Q2 in FIG. 17B). As a result, durability of the locking arm portion 66 (and further, durability of the connector connection structure 1) is improved.

Figure 18:
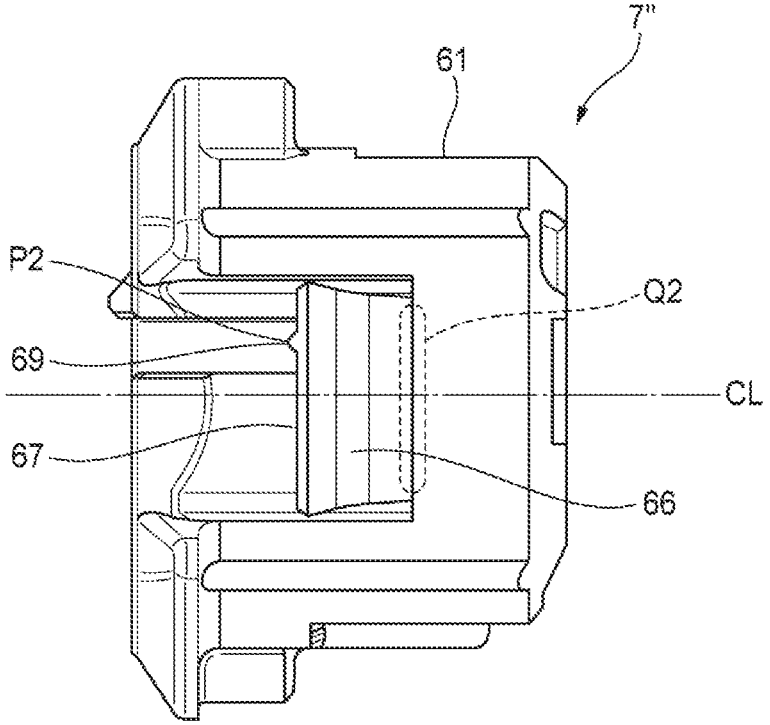
FIG. 18 is a diagram illustrating transmission of a force when acts on a shunt ring according to a modification of the embodiment.

As illustrated in a shunt ring 7" according to a modification illustrated in FIG. 18, even though a protruding portion 69 protruding to the front side in the fitting direction is formed at the intermediate place P2 in the up and down direction of the tip surface 67 of the locking arm portion 66 (the same place as the place where the tapered surface 68 starts), a structure in which the intermediate place P2 first receives the force from the abutting surface 55 can be obtained, such that the same action and effect as those of the shunt ring 7 according to the embodiment can be obtained. Even though a protruding portion protruding to the rear side in the fitting direction is formed at a location corresponding to the intermediate place P2 on the abutting surface 55 of the holder 6, the same action and effect as those of the shunt ring 7 according to the embodiment can be obtained.

As described above, according to the second connector 3 according to the embodiment of the present disclosure, since a guide mechanism is formed in such a manner that the pair of ribs 23 and the pair of groove portions 37 extending in the fitting direction are engaged with each other, the slider 5 can be stably moved in the fitting direction with respect to the housing 4. Since the stopper portion 24 for preventing the slider 5 from being detached from the housing 4 to the front side in the fitting direction is provided at a location where the rigidity adjacent to the end part on the front side in the fitting direction of the guide mechanism is extremely high, even when moment rotating with the width direction as an axis acts on the slider 5, a state where the slider 5 is detached from the housing 4 by breaking through the stopper portion 24 is extremely hard to occur.

Since the tapered surface 23*a* is formed on the top surface of the rib 23, in a state where the slider 5 is displaced upward from the appropriate location that coincides with the fitting of the groove portion 37 and the rib 23 with respect to the housing 4, the downward force is automatically generated in the slider 5 when the slider is caused to be mounted on the housing 4. Therefore, the slider 5 can be automatically assembled thereto at the appropriate location where the groove portion 37 and the rib 23 are fitted to each other simply by pushing the slider 5 to the rear side in the fitting direction with respect to the housing 4. Therefore, when the slider 5 is mounted on the housing 4, in the state where the slider 5 is displaced upward from the appropriate location that coincides with the fitting of the groove portion 37 and the rib 23 with respect to the housing 4 due to a surrounding situation, the slider 5 can be automatically assembled thereto at the appropriate location simply by pushing the slider 5 to the rear side in the fitting direction with respect to the housing 4 when it is required to mount the slider 5 on the housing 4.

The present disclosure is not limited to the above-described embodiments, and various modifications can be adopted within the scope of the present disclosure. For example, the present disclosure is not limited to the above-described embodiments, and can be appropriately modified and improved. The material, shape, size, number, and arrangement place of each component in the above-described embodiments are freely determined and are not limited as long as the present disclosure can be achieved.

In the second connector 3 according to the embodiment, due to a fact that the taper surface 23*a* is inclined to be located inside in the width direction as going downward in the up and down direction, in the state where the slider 5 is displaced upward from the appropriate position that coincides with the fitting of the groove portion 37 and the rib 23 with respect to the housing 4, the downward force is configured to be automatically generated in the slider 5 when the slider 5 is caused to be mounted on the housing 4. On the other hand, the tapered surface 23*a* may be configured to be inclined to be located inside in the width direction as going upward in the up and down direction. Here, in a state where the slider 5 is displaced downward from the appropriate position that coincides with the fitting of the groove portion 37 and the rib 23 with respect to the housing 4, an upward force is configured to be automatically generated in the slider 5 when the slider 5 is caused to be mounted on the housing 4. As a result, when the slider 5 is mounted on the housing 4, in the state where the slider 5 is displaced downward from the appropriate location that coincides with the fitting of the groove portion 37 and the rib 23 with respect to the housing 4 due to a surrounding situation, the slider 5 can be automatically assembled thereto at the appropriate location simply by pushing the slider 5 to the rear side in the fitting direction with respect to the housing 4 when it is required to mount the slider 5 on the housing 4.

In the embodiment, the guide mechanism includes: the pair of ribs 23 provided on the opposite sides in the width direction of the housing 4; and the pair of groove portions 37 provided on the opposite sides in the width direction of the slider 5. Alternatively, the guide mechanism may include: the pair of groove portions provided on the opposite sides in the width direction of the housing 4; and the pair of ribs provided on the opposite sides in the width direction of the slider 5.

The connector connection structure 1 according to the embodiment is used for the in-vehicle airbag system. Meanwhile, the connector connection structure 1 may be used for any system as long as the system can generate the mode in which the impact in the direction of separating the first and second connectors 2 and 3 from each other (the direction in which the first and second connectors 2 and 3 move to the rear side in the fitting direction) is applied to the first and second connectors 2 and 3 fitted to each other.

Hereinafter, the embodiments of the connecter 3 according to the present disclosure are summarized as follows.

According to a first illustrative aspect of the present disclosure, a connector (3) is configured to be fitted to a counterpart connector (2) at each of front sides thereof in a fitting direction in which the connector (3) and the counterpart connector (2) approach to each other. The connector (3) includes: a housing (4) having a connection portion (12) which is connected to the counterpart connector (2); and a slider (5) which is held in the housing (4) to be movable in the fitting direction, and which is energized toward the front side of the connector (3) in the fitting direction with an energizing member (41), the slider (5) being configured to apply a force to the front side of the connector (3) in the fitting direction due to an energizing force of the energizing member (41) by abutting on the counterpart connector (2) during a fitting operation to the counterpart connector (2) The housing (4) and the slider (5) include: a guide mechanism (23, 37) configured to guide a movement of the slider (5) to the housing (4) in the fitting direction; and a stopper mechanism (24, 36) configured to prevent the slider (5) from being detached from the housing (4) to the front side of the connector (3) in the fitting direction. The guide mechanism (23, 37) has: a pair of ribs (23) provided in one of the housing (4) and the slider (5), the ribs (23) being provided on opposite sides in a width direction orthogonal to the fitting direction in the one of the housing (4) and the slider (5), the ribs (23) extending in the fitting direction in the one of the housing (4) and the slider (5); and a pair of grooves (37) provided in the other of the housing (4) and the slider (5), the grooves (37) being provided on opposite sides in the width direction in the other of the housing (4) and the slider (5), the grooves (37) extending in the fitting direction to engage with the pair of ribs (23) in the other of the housing (4) and the slider (5). The stopper mechanism (24, 36) is provided at a location adjacent to an end part of the guide mechanism (24, 36) at the front side of the connector (3) in the fitting direction.

According to a second illustrative aspect of the present disclosure, wherein the guide mechanism (23, 37) has a structure configured such that: when mounting the slider (5) on the housing (4), the slider (5) is displaced from an appropriate location at which the grooves (37) and the ribs (23) are appropriately fitted with each other, with respect to the housing (4), to one side in an up-and-down direction orthogonal to the fitting direction and the width direction; and the slider (5) receives a force in the width direction from an abutting place between the slider (5) and the housing (4) due to a fact that the grooves (37) and the ribs (23) are not fitted to each other when displacing the slider (5), whereby an elastic restoring force of the slider (5) gives the slider (5) a force toward the other side in the up-and-down direction at the abutting place, when opposite side portions of the slider (5) in the width direction are elastically deformed to be displaced in the width direction.

According to a third illustrative aspect of the present disclosure, the guide mechanism (23, 37) includes: the pair of ribs (23) provided, in the housing (4), on the opposite sides in the width direction; and the pair of grooves (37) provided, in the slider (5), on the opposite sides in the width direction. The structure includes a tapered surface (23*a*) formed on a top surface of each of the ribs (23), the top surface serving as the abutting place. The tapered surface (23*a*) is inclined to be located inwardly in the width direction as going toward the other side in the up-and-down direction.

According to a fourth illustrative aspect of the present disclosure, the connector (3) and the counterpart connector (2) are electrical connectors of an in-vehicle airbag system, the counterpart connector (2) corresponding to a connector at a side of an inflator provided in the inflator of the airbag system, the connector (3) corresponding to a connector at a side of a wire harness which supplies a control signal to the inflator.

What is claimed is:

1. A connector configured to be fitted to a counterpart connector at each of front sides thereof in a fitting direction in which the connector and the counterpart connector approach to each other, the connector comprising:

a housing having a connection portion which is connected to the counterpart connector; and a slider which is held in the housing to be movable in the fitting direction, and which is energized toward the front side of the connector in the fitting direction with an energizing member, the slider being configured to apply a force to the front side of the connector in the fitting direction due to an energizing force of the energizing member by abutting on the counterpart connector during a fitting operation to the counterpart connector, wherein the housing and the slider include:

a guide mechanism configured to guide a movement of the slider to the housing in the fitting direction; and a stopper mechanism configured to prevent the slider from being detached from the housing to the front side of the connector in the fitting direction, wherein the guide mechanism has:

a pair of ribs provided in one of the housing and the slider, the ribs being provided on opposite sides in a width direction orthogonal to the fitting direction in the one of the housing and the slider, the ribs extending in the fitting direction in the one of the housing and the slider; and a pair of grooves provided in the other of the housing and the slider, the grooves being provided on opposite sides in the width direction in the other of the housing and the slider, the grooves extending in the fitting direction to engage with the pair of ribs in the other of the housing and the slider, and wherein the stopper mechanism is provided at a location adjacent to an end part of the guide mechanism at the front side of the connector in the fitting direction.

2. The connector according to claim 1, wherein the guide mechanism has a structure configured such that:

when mounting the slider on the housing, the slider is displaced from an appropriate location at which the grooves and the ribs are appropriately fitted with each other, with respect to the housing; to one side in an up-and-down direction orthogonal to the fitting direction and the width direction; and the slider receives a force in the width direction from an abutting place between the slider and the housing due to a fact that the grooves and the ribs are not fitted to each other when displacing the slider, whereby an elastic restoring force of the slider gives the slider a force toward the other side in the up-and-down direction at the abutting place, when opposite side portions of the slider in the width direction are elastically deformed to be displaced in the width direction.

3. The connector according to claim 2, wherein the guide mechanism includes:

the pair of ribs provided; in the housing, on the opposite sides in the width direction; and the pair of grooves provided, in the slider, on the opposite sides in the width direction, wherein the structure includes a tapered surface formed on a top surface of each of the ribs, the top surface serving as the abutting place, and wherein the tapered surface is inclined to be located inwardly in the width direction as going toward the other side in the up-and-down direction.

4. The connector according to claim 1, wherein the connector and the counterpart connector are electrical connectors of an in-vehicle airbag system, the counterpart connector corresponding to a connector at a side of an inflator provided in the inflator of the airbag system, the connector corresponding to a connector at a side of a wire harness which supplies a control signal to the inflator.

5. The connector according to claim 2, wherein the connector and the counterpart connector are electrical connectors of an in-vehicle airbag system, the counterpart connector corresponding to a connector at a side of an inflator provided in the inflator of the airbag system, the connector corresponding to a connector at a side of a wire harness which supplies a control signal to the inflator.

6. The connector according to claim 3, wherein the connector and the counterpart connector are electrical connectors of an in-vehicle airbag system, the counterpart connector corresponding to a connector at a side of an inflator provided in the inflator of the airbag system, the connector corresponding to a connector at a side of a wire harness which supplies a control signal to the inflator.

* * * * *